US005673709A

United States Patent [19]

Brothers

[11] Patent Number: 5,673,709

[45] Date of Patent: Oct. 7, 1997

[54] PORTABLE ASHTRAY

[76] Inventor: Harlan Jay Brothers, 103 Island View Ter., Branford, Conn. 06405

[21] Appl. No.: 310,031

[22] Filed: Sep. 21, 1994

[51] Int. Cl.[6] ..... A24D 1/12

[52] U.S. Cl. ..... 131/231; 131/238; 131/239

[58] Field of Search ..... 131/231, 238, 131/239; 220/576, 260; 223/67; 206/86, 87, 85, 246

[56] References Cited

FOREIGN PATENT DOCUMENTS 0187849 11/1922 United Kingdom ..... 206/86

*Primary Examiner*—Vincent Millin
*Assistant Examiner*—Charles W. Anderson
*Attorney, Agent, or Firm*—Robert L. Tucker

[57] ABSTRACT

A portable astray includes a receptacle portion for receiving a cigarette and a releasably attached top portion for covering the receptacle portion. The top portion includes an aperture of sufficient size to allow a cigarette to pass therethrough to the receptacle portion. A flap is included for closing the aperture, the flap being constructed and arranged to move between a first position whereby the aperture is closed, and a second position whereby the aperture is open to allow the cigarette to pass through the aperture to the receptacle portion.

21 Claims, 6 Drawing Sheets

PORTABLE ASHTRAY

BACKGROUND OF THE INVENTION

1. Field of the Invention

The present invention relates to ashtrays. More particularly, it relates to pocket size ashtrays which are safe and easy to use.

2. Description of the Prior Art

People who smoke on the move or outdoors often have no means for the disposal of their cigarette butts. The result is an unsightly sea of spent cigarette refuse which litters streets and otherwise pristine public places.

Previous attempts to remedy this problem consist of little more than an ornamental design for a box with an opening and a cover. As a result, they are not particularly safe. Unsecured tops can accidently open, releasing burning contents into the pocket. Previous designs are also inconvenient because both hands must be used in order to open the lid or covering. In addition, they are difficult to clean properly which is important if the user does not wish his or her pockets to smell like the ashtray itself. Furthermore, they are limited in application in that they are designed solely for use in a pocket or purse.

SUMMARY OF THE INVENTION

Accordingly, it is an object of the present invention to provide a means for the disposal of cigarettes that is ecologically sound, compact, convenient, and easy to use.

Another object is to provide such a means that is particularly safe.

A further object is to provide such a means that is easy to clean.

It is also an object to provide such a means that is not limited in application and can therefore enjoy widespread use.

It is another object to provide such a means that is technically uncomplicated, aesthetically pleasing and inexpensive to manufacture.

It has been found that the above and other objects of the present invention are attained in a portable astray including a receptacle portion for receiving a cigarette; and, a releasably attached top portion for covering the receptacle portion, the top portion including an aperture of sufficient size to allow a cigarette to pass therethrough to the receptacle portion. A flap is included for closing the aperture, the flap being constructed and arranged to move between a first position whereby the aperture is closed, and a second position whereby the aperture is open to allow the cigarette to pass through the aperture to the receptacle portion.

In a preferred embodiment, the aperture includes a gasket to substantially seal the receptacle portion when the flap is engaged in the first closed position. Preferably, the gasket provides a substantially airtight seal.

In a preferred embodiment, the portable ashtray includes means for attaching the ashtray to an object.

Preferably, the receptacle portion includes means for receiving the top portion, and the means for receiving the top portion further includes means for supporting the cigarette.

In a preferred embodiment, the receptacle portion is adapted to receive and store cigarette ashes and the receptacle portion includes a bottom portion, and the bottom portion includes means for receiving the top portion.

Preferably, a spring maintains the flap in the first closed position and the spring is sufficiently biased to allow the flap to move to the second open position when the cigarette is caused to be moved through the aperture. Preferably, the spring causes the flap to move back into the first closed position after the cigarette passes through the aperture.

In a preferred embodiment, a portable ashtray includes a receptacle portion, the receptacle portion including a refuse chamber for receiving a cigarette, and a lighter chamber for receiving a cigarette lighter. A releasably attached top portion covers the receptacle portion, and the top portion includes a cigarette aperture of sufficient size to allow a cigarette to pass therethrough into the refuse chamber. A lighter aperture of sufficient size receives the cigarette lighter and allows at least part of the cigarette lighter to pass into the lighter chamber. A flap is included for closing the cigarette aperture, the flap being constructed and arranged to move between a first position whereby the cigarette aperture is closed, and a second position whereby the cigarette aperture is open to allow the cigarette to pass therethrough into the refuse chamber.

Other features and advantages of the present invention will become apparent from the following description of the invention which refers to the accompanying drawings.

BRIEF DESCRIPTION OF THE DRAWING(S)

For the purpose of illustrating the invention, there is shown in the drawings an embodiment which is presently preferred; it being understood, however, that the invention is not limited to the precise arrangements and instrumentalities shown.

DETAILED DESCRIPTION OF THE INVENTION

Figure 1:
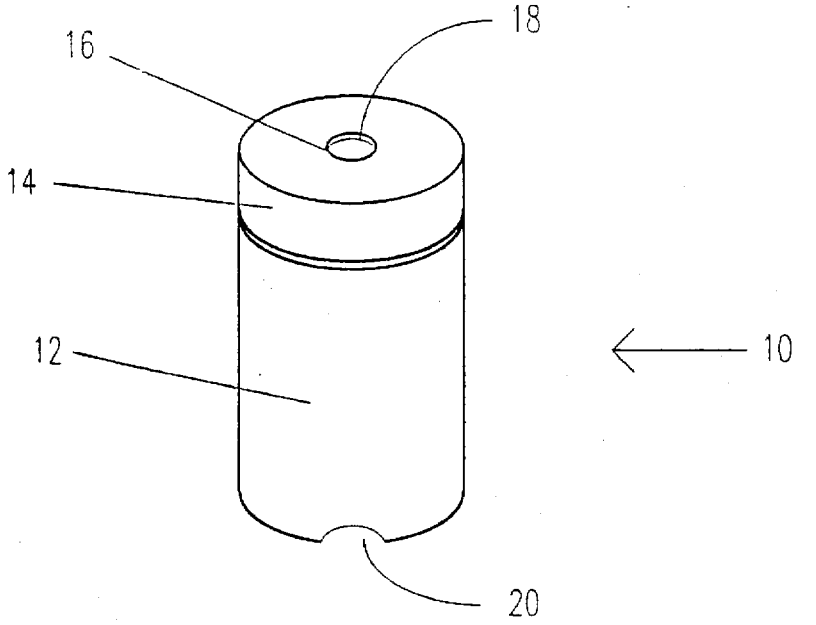
FIG. 1 is a perspective view of the portable ashtray of the present invention.

Referring now to the drawings wherein like numerals indicate like elements, there is shown in FIGS. 1–5 a portable ashtray 10 of the present invention. The portable ashtray 10 is comprised of a receptacle portion 12 and a top removable portion 14. The portable ashtray 10 should be constructed of any of the known fire retardant or fire resistant materials. Preferably, the portable ashtray 10 should be constructed of a high temperature plastic such as Nylon 66.

The top portion 14 includes an aperture 16 through which a cigarette butt, not shown, can be passed to the inside of the receptacle portion 12, although it should be realized by those skilled in the art that the ashtray 10 can be constructed and arranged to be used in connection with other types of smokes, such as cigars and the like.

The top portion 14 includes a spring loaded flap 18 to seal the aperture 16 unless a cigarette is being pushed through the aperture 16 and into the receptacle portion 12.

Figure 2:
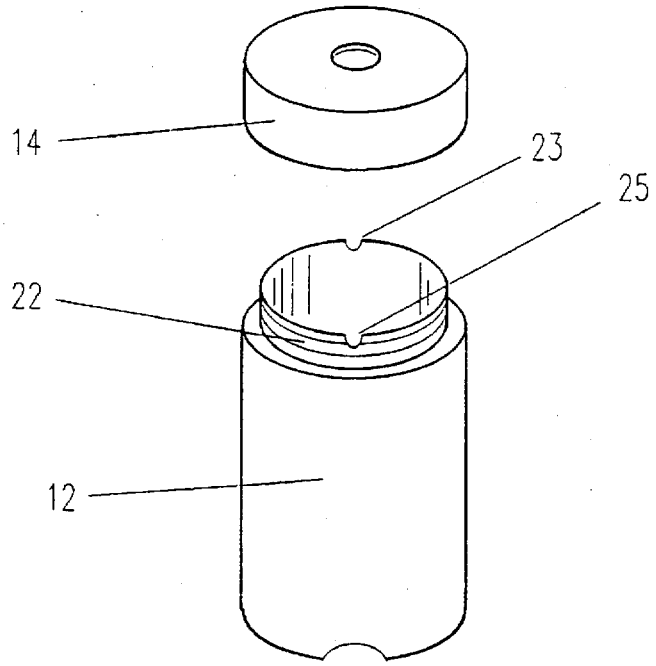
FIG. 2 is an exploded perspective view of the portable ashtray of FIG. 1.

FIG. 2 shows the portable ashtray 10 with the top portion 14 removed revealing a screw sleeve 22 at the top of the receptacle portion 12. The screw sleeve 22 mates with a screw sleeve 28, FIG. 3, on the inside of the top portion 14. Two semi-circular notches 23 and 25 are cut into the screw sleeve 22 and serve as a cigarette rest.

Figure 3:
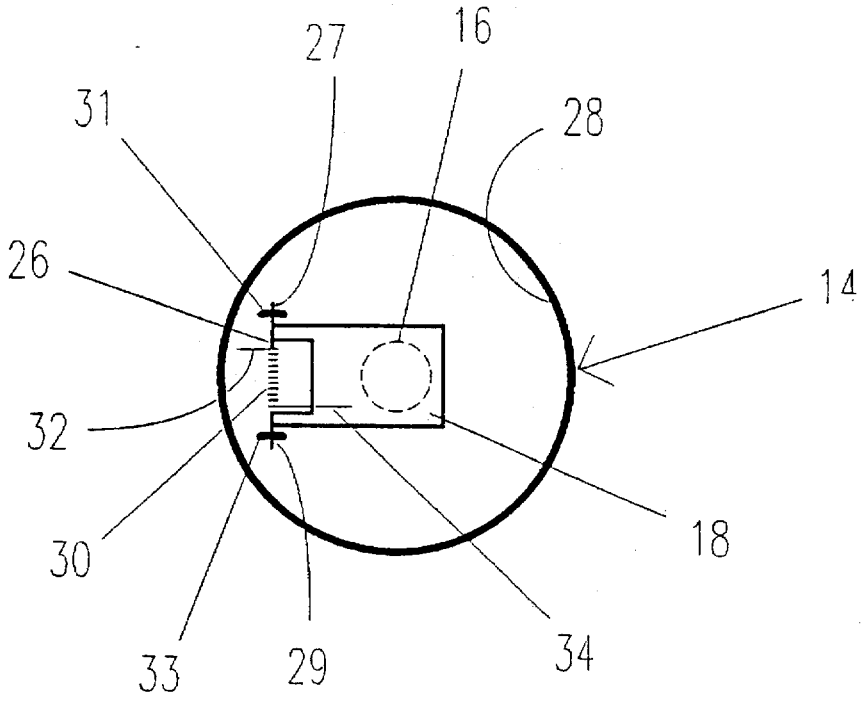
FIG. 3 is a bottom plan view of the top portion of FIG. 1 revealing the flap mechanism in a closed position.

Referring now to FIG. 3, the spring loaded flap 18 which serves to cover the aperture 16, includes a spring mounting member 26 and pivot pins 27 and 29. The pivot pins 27 and 29 are inserted into, and rotate freely within, pin retaining members 31 and 33, respectively. The spring mounting member 26 is inserted through the center of the spring 30 thereby holding it in place. The spring 30 maintains the flap 18 in a closed position by means of movable spring arm 34 until such a time that a cigarette butt or the like is pushed through the aperture 16. At that time, the flap 18 temporarily yields to allow the cigarette butt to enter the receptacle portion 12, FIG. 2, after which the flap 18 returns to a closed position. A stationary spring arm 32 prevents the spring 30 from rotating when the flap 18 pivots into an open position.

It should be realized by those skilled in the art that the present invention is not limited to the precise arrangement and structure of the spring loaded flap 18 described above. Any structure or means can be used for enabling the flap 18 to close and open the aperture 16 in a manner consistent with the present invention.

Figure 4:
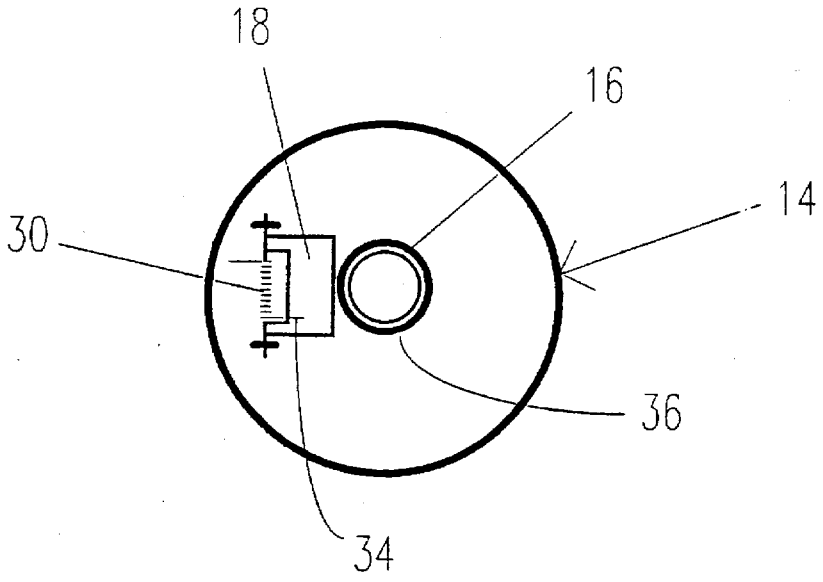
FIG. 4 is a bottom plan view of the top portion of FIG. 1 revealing the flap mechanism in a raised position.

FIG. 4 shows the inside of the top portion 14 with the flap 18 raised so as to reveal a gasket 36 encircling the aperture 16. The movable spring arm 34 of the spring 30 provides the restoring force to return the flap 18 to a closed position flush against the gasket 36. The gasket 36 provides an airtight seal between the flap 18 and the aperture 16 which serves three functions. First, it starves any burning material for oxygen. Second, it prevents any smoke from escaping while the cigarette butt extinguishes. Third, it prevents stale oder from escaping which is desirable if the user places the device in a pocket, purse or the like.

Figure 5:
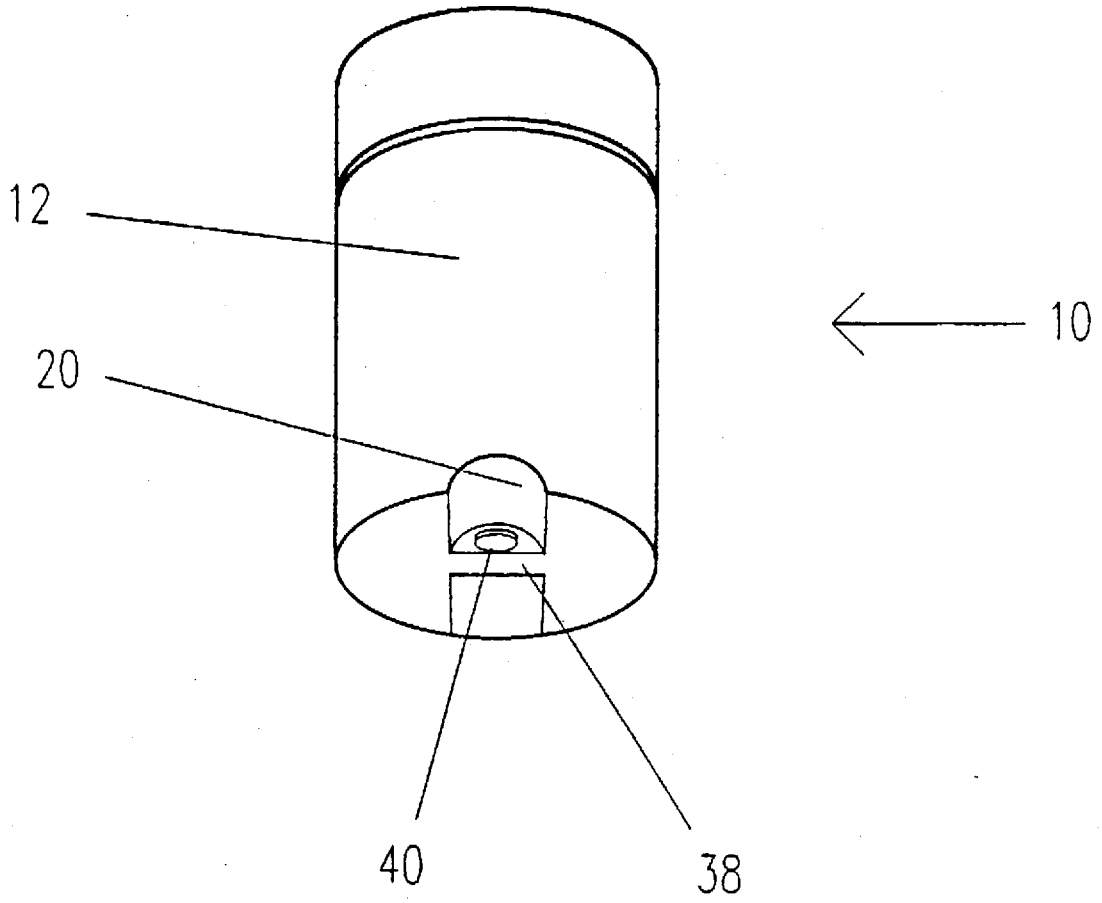
FIG. 5 is a perspective view of the portable ashtray of FIG. 1 from below.

FIG. 5 shows the portable ashtray 10 in perspective from below. At the base of the receptacle portion 12 is a semi-cylindrical channel 20. Across the mid-portion of the channel 20 is a bridge 38. Through the center of the bridge 38 is a hole 40 which is provided to allow for the attachment of a clip-on chain or loop so as to allow the ashtray 10 to be hung, for example, from a belt loop or a golf bag.

It can be seen from the preceding description that the portable ashtray 10 of the present invention provides a convenient means for the disposal of cigarette waste. A cigarette butt can be pushed through the aperture 16 and into the receptacle portion 12 where it is suffocated by the seal between the closed flap 18, the gasket 36 and the aperture 16. The portable ashtray 10 provides a removable top portion 14 to allow for easy cleaning of the inside of the device and also to allow the user to rest his or her cigarette across one or both of the semi-circular notches 23 and 25. In addition, ashes can be easily tapped into the opened receptacle portion 12. Lastly, by providing a recessed hole 40 in the bottom of the ashtray 10, the user can employ the device in a variety of situations.

Figure 6:
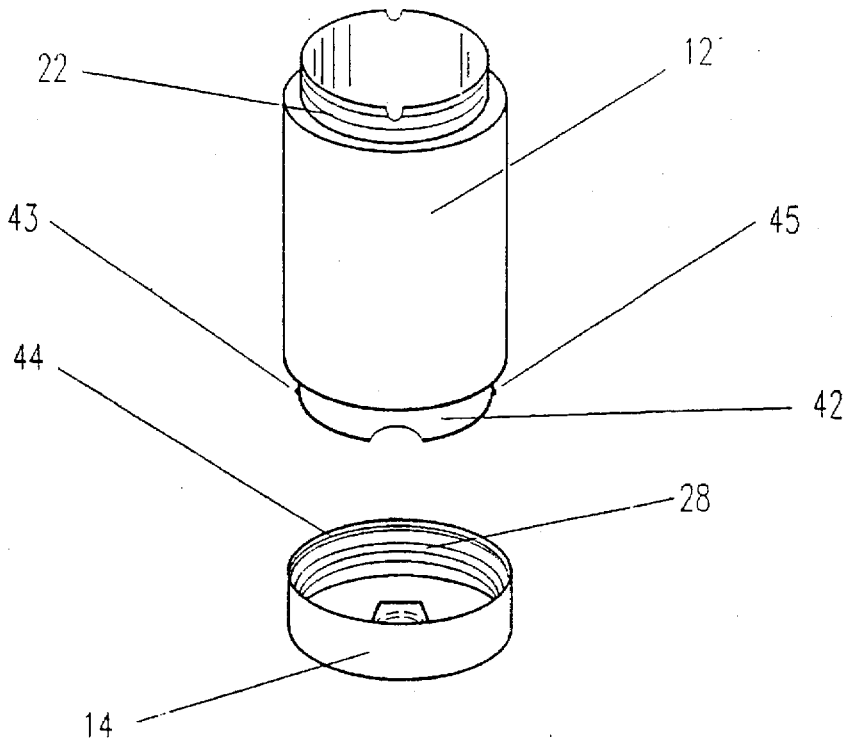
FIG. 6 is an alterative embodiment of the portable ashtray of FIG. 1.
Figure 7:
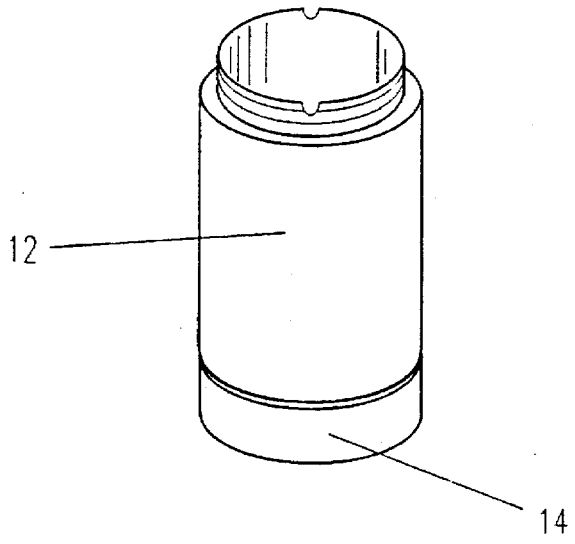
FIG. 7 is the portable ashtray of FIG. 6 shown with the top portion engaged with the bottom of the receptacle portion.

In a preferred embodiment, additional convenience is afforded by allowing the top of the ashtray 14, when removed, to be attached to the receptacle portion 12 so that the user does not have to hold, put down, or pocket the removable top when in the process of smoking and using the device as an ash receptacle. Referring now to FIG. 6, the bottom receptacle portion 12 includes a recessed base 42 from which protuberances 43 and 45 extend. The protuberances 43 and 45 are designed to snap into the groove 44 which is located between the inside rim of the top portion 14 and the screw sleeve 28. FIG. 7 illustrates how the top portion 14, when unscrewed and removed from the top of the bottom receptacle portion 12, can be inverted and temporarily snapped onto the recessed base 42, FIG. 6, of the bottom receptacle portion 12.

Figure 8:
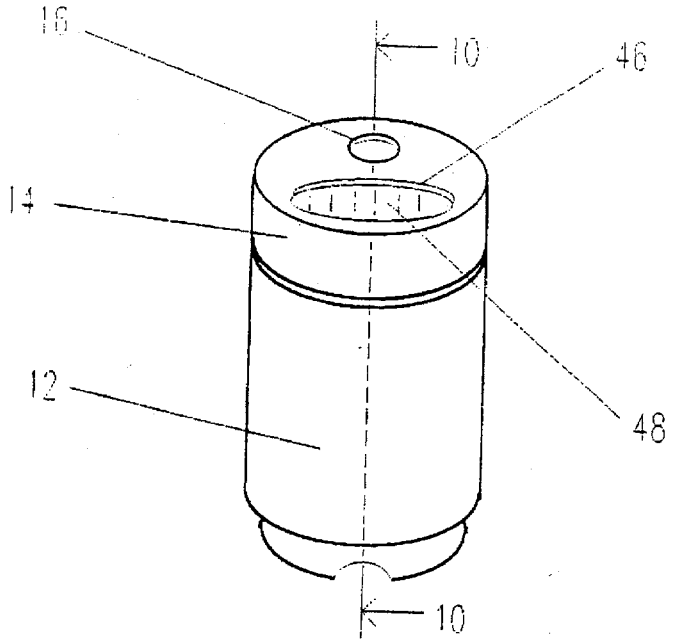
FIG. 8 is an alternative embodiment of the portable ashtray of the present invention which can accommodate a portable lighter.

An alternative embodiment of the present invention allows the device to accommodate a disposable lighter so that the user can conveniently have on hand, both a lighter and an ashtray. Referring now to FIG. 8, the top portion 14 includes both the cigarette aperture 16 and a lighter aperture 46 which is shaped to accommodate a standard butane lighter, although it should be realized by those skilled in the art that the lighter aperture 46 can be constructed to accommodate lighters of any size or shape.

Figure 9:
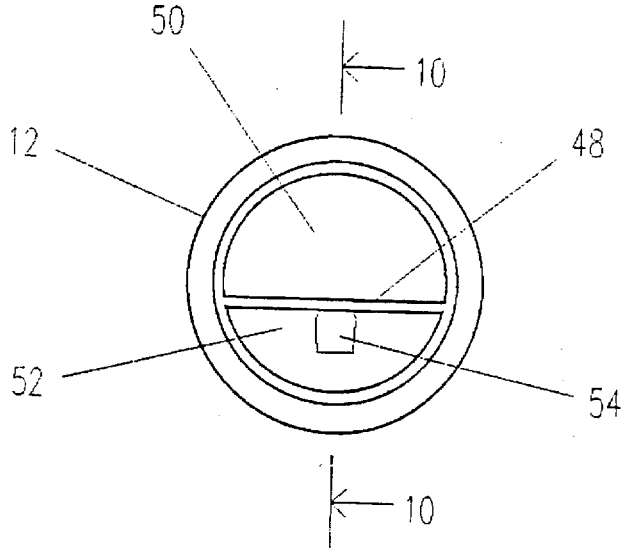
FIG. 9 is a bottom plan view of the receptacle portion of the portable ashtray of FIG. 8.

Referring now to FIGS. 8, 9, a dividing wall 48 separates the bottom receptacle portion 12 into two chambers, 50, 52. The refuse chamber 50 is aligned with the cigarette aperture 16 and the lighter chamber 52 is aligned with the lighter aperture 46.

Figure 10:
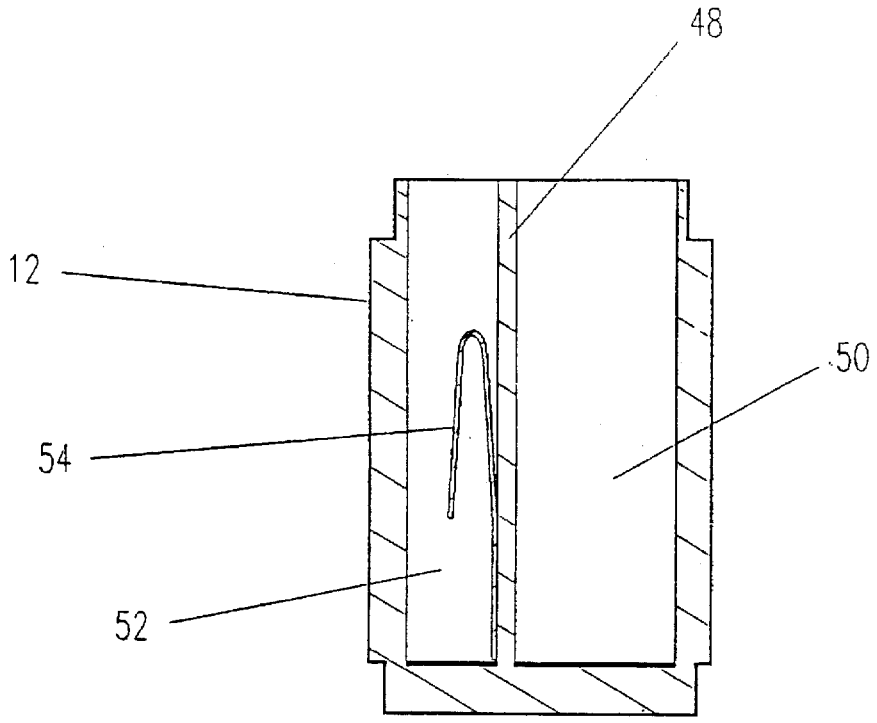
FIG. 10 is the portable ashtray of FIG. 8 taken along line 10—10 of FIG. 9.

Referring now to FIGS. 9, 10, a leaf spring 54 is mounted in the lighter chamber 52 to hold an inserted lighter in place. The leaf spring 54 applies minimal, but sufficient pressure, against the inserted lighter.

Figure 11:
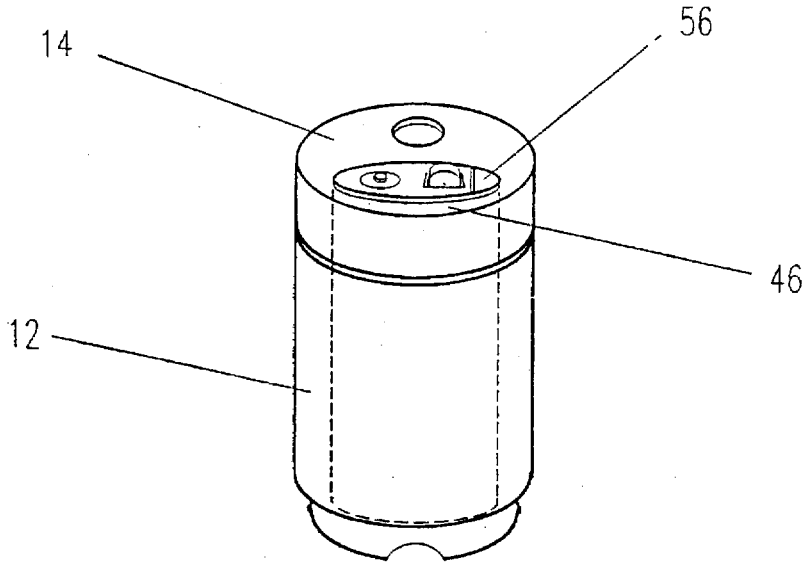
FIG. 11 is the portable ashtray of FIG. 8 including a disposable lighter stored therein.

Referring now to FIG. 11, a lighter 56 is shown inserted through the lighter aperture 46, in top portion 14, and into the lighter chamber 52 of the bottom receptacle portion 12 where it is held in place by the leaf spring 54, FIG. 10. It should be realized by those skilled in the art that the lighter aperture 46 does not necessarily have to be located in the top portion 14 and that lighter chamber 52 can be accessed by alternative means.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A portable ashtray comprising:

a receptacle for receiving a smoking article having a top and a bottom portion;

the top portion including an aperture of sufficient size to allow a smoking article to pass therethrough to the bottom portion; and a flap operatively engaged with the top portion, the flap being capable of moving between a first closed position to substantially close the aperture and a second open position to substantially open the aperture, the flap being constructed and arranged to be moved into the second open position when a smoking article is caused to be passed through the aperture.

2. The portable ashtray of claim 1, whereby the aperture includes a gasket to substantially seal the receptacle portion when the flap is engaged in the first closed position.

3. The portable ashtray of claim 2, whereby the gasket provides a substantially airtight seal.

4. The portable ashtray of claim 1, including means for attaching the ashtray to an object.

5. The portable ashtray of claim 1, whereby the receptacle portion is constructed and arranged to receive the top portion.

6. The portable ashtray of claim 5, whereby the receptacle portion is constructed and arranged to receive and support the cigarette.

7. The portable ashtray of claim 1, whereby the receptacle portion is adapted to receive and store cigarette ashes.

8. The portable ashtray of claim 1, whereby the receptacle portion includes a bottom portion, and the bottom portion is constructed and arranged to receive the top portion.

9. The portable ashtray of claim 1, whereby the flap substantially covers the aperture in the first closed portion, and a spring maintains the flap in the first closed position.

10. The portable ashtray of claim 9, whereby the spring is sufficiently biased to allow the flap to move to the second open position when the cigarette is caused to be moved into the aperture.

11. The portable ashtray of claim 10, whereby the spring causes the flap to move back into the first closed position after the cigarette passes into the aperture.

12. A portable ashtray comprising:

a receptacle for receiving a smoking article having a top and a bottom portion;

the bottom portion including a chamber for receiving a lighter;

the top portion including an aperture of sufficient size to allow a smoking article to pass therethrough to the bottom portion; and a flap operatively engaged with the top portion, the flap being capable of moving between a first closed position to substantially close the aperture and a second open position to substantially open the aperture, the flap being constructed and arranged to be moved into the second open position when a smoking article is caused to be passed through the aperture.

13. The portable ashtray of claim 12, whereby the cigarette aperture includes a gasket to substantially seal the refuse chamber when the flap is engaged in the first closed position.

14. The portable ashtray of claim 13, whereby the gasket provides a substantially airtight seal.

15. The portable ashtray of claim 12, whereby the lighter chamber holds a cigarette lighter therein.

16. The portable ashtray of claim 12, whereby a spring maintains the flap in the first closed position.

17. The portable ashtray of claim 16, whereby the spring is sufficiently biased to allow the flap to move to the second open position when a cigarette is caused to move into the cigarette aperture.

18. The portable ashtray of claim 17, whereby the spring causes the flap to move back into the first closed position after the cigarette passes into the cigarette aperture.

19. The portable ashtray of claim 12, whereby the receptacle portion receives the top portion.

20. The portable ashtray of claim 19, whereby the receptacle portion is constructed and arranged to receive and support the cigarette.

21. The portable ashtray of claim 12, whereby the receptacle portion includes a bottom portion, and the bottom portion is constructed and arranged to receive the top portion.

* * * * *